US010089886B2

(12) United States Patent
Kawalkar et al.

(10) Patent No.: US 10,089,886 B2
(45) Date of Patent: Oct. 2, 2018

(54) VEHICLE DECISION SUPPORT SYSTEM

(71) Applicant: HONEYWELL INTERNATIONAL INC., Morris Plains, NJ (US)

(72) Inventors: Amit Nishikant Kawalkar, Karnataka (IN); Rajeev Mohan, Karnataka (IN); Piyush Varshney, Karnataka (IN); Sudhir Hebbar, Karnataka (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 166 days.

(21) Appl. No.: 15/014,609

(22) Filed: Feb. 3, 2016

(65) Prior Publication Data

US 2017/0221367 A1 Aug. 3, 2017

(51) Int. Cl.
*G08G 5/00* (2006.01)

(52) U.S. Cl.
CPC ..... *G08G 5/0039* (2013.01); *G08G 5/0013* (2013.01); *G08G 5/0021* (2013.01); *G08G 5/0034* (2013.01)

(58) Field of Classification Search
CPC ..... G08G 5/00; G08G 5/0004; G08G 5/0008; G08G 5/0013; G08G 5/0017; G08G 5/0021; G08G 5/0026; G08G 5/0047; G08G 5/0056; G08G 5/006; G08G 5/0065; G08G 5/0073; G08G 5/0078; G08G 5/0082; G08G 5/0086; G08G 5/0091; G08G 5/0095; G08G 5/02; G08G 5/025; G08G 5/04; G08G 5/045; G08G 5/06; G08G 5/065; G08G 5/003; G08G 5/0034; G08G 5/0039; G06Q 10/04; G06Q 10/047; G05B 2219/23448; G01C 21/3446; G01C 21/3453; G01C 21/3461; G01C 21/3469
See application file for complete search history.

(56) References Cited

U.S. PATENT DOCUMENTS

| | | | | |
|---|---|---|---|---|
| 6,199,008 | B1 * | 3/2001 | Aratow | G01C 23/00 701/120 |
| 6,700,482 | B2 * | 3/2004 | Ververs | G01C 23/00 340/500 |
| 6,778,906 | B1 * | 8/2004 | Hennings | G05D 1/0061 340/961 |
| 7,529,603 | B2 | 5/2009 | Allen et al. | |
| 7,925,393 | B2 | 4/2011 | Bolt, Jr. et al. | |
| 8,301,368 | B1 | 10/2012 | Masson | |
| 8,514,104 | B1 * | 8/2013 | Dirks | G01C 23/00 340/945 |
| 8,600,587 | B1 * | 12/2013 | Seah | G08G 5/045 701/10 |
| 8,676,481 | B2 | 3/2014 | Coulmeau et al. | |
| 8,723,686 | B1 * | 5/2014 | Murray | G08G 5/0039 340/901 |

(Continued)

OTHER PUBLICATIONS

Allen, D.; Electronic Flight Bag, The Boeing Company, 2003.

(Continued)

*Primary Examiner* — Thomas G Black
*Assistant Examiner* — Sara J Lewandroski
(74) *Attorney, Agent, or Firm* — Lorenz & Kopf, LLP

(57) ABSTRACT

A vehicle decision support system and method capable of processing operational constraints, a flight plan, and appropriate environmental data to generate timely and readily comprehensible guidance are provided.

20 Claims, 7 Drawing Sheets

(56) References Cited

U.S. PATENT DOCUMENTS 8,798,811 B2 8/2014 Vial
8,843,303 B1 * 9/2014 Young ..... G08G 5/0039 701/122
9,087,419 B2 * 7/2015 Lentz ..... G01M 17/00
9,542,851 B1 * 1/2017 Kim ..... G08G 5/0047
9,691,287 B1 * 6/2017 Shapiro ..... G06F 3/013
2002/0039070 A1 * 4/2002 Ervers ..... G01C 23/00 340/901
2005/0283281 A1 * 12/2005 Hartmann ..... G01C 21/00 701/4
2006/0271275 A1 * 11/2006 Verma ..... G07C 5/0816 701/532
2007/0294026 A1 * 12/2007 Schirmer ..... B60W 10/06 701/533
2009/0150012 A1 6/2009 Agam et al.
2011/0118908 A1 * 5/2011 Boorman ..... G08G 5/0021 701/14
2011/0208374 A1 * 8/2011 Jayathirtha ..... G05D 1/0676 701/5
2012/0218127 A1 * 8/2012 Kroen ..... G08G 5/0034 340/945
2012/0245834 A1 * 9/2012 Klooster ..... G08G 5/0034 701/120
2012/0277952 A1 * 11/2012 MacNeille ..... G01C 21/3453 701/36
2014/0046585 A1 * 2/2014 Morris, IV ..... G01C 21/00 701/468
2014/0129058 A1 * 5/2014 Elahi ..... G08G 5/0021 701/16
2014/0156109 A1 * 6/2014 Estkowski ..... G05D 1/101 701/2
2014/0343761 A1 * 11/2014 Pastor ..... B64C 13/18 701/7
2015/0241233 A1 * 8/2015 Loftus ..... G01C 21/3469 701/410
2015/0261829 A1 * 9/2015 Whitlow ..... G06F 17/30539 707/722
2016/0019795 A1 * 1/2016 Chircop ..... G08G 5/0034 701/7
2016/0059872 A1 * 3/2016 Kumar ..... B61L 3/006 701/19
2016/0210863 A1 * 7/2016 Kohn-Rich ..... G05D 1/0646
2016/0349760 A1 * 12/2016 Singh ..... G05D 1/0808
2017/0132942 A1 * 5/2017 Mere ..... G08G 5/0047
2017/0365178 A1 * 12/2017 Shay ..... G08G 5/02
2018/0040250 A1 * 2/2018 Sawhill ..... G08G 5/0017

OTHER PUBLICATIONS

Electronic Flight Bags, Teledyne Controls, 2005.
Partial EP Search Report for Application No. 171516917-1803 dated Jun. 21, 2017.
Extended EP Search Report for Application No. 17151691.7-1803 / 3203459 dated Jul. 11, 2017.

* cited by examiner

VEHICLE DECISION SUPPORT SYSTEM

TECHNICAL FIELD

Embodiments of the subject matter described herein relate generally to vehicle decision support systems and, more particularly, to a vehicle decision support system that predicts the effects of operational constraints and generates guidance therefrom.

BACKGROUND

Operational constraints are limitations on a vehicle's current or predicted status or performance. Non-limiting examples of operational constraints include maximum altitude, maximum speed, turning radius, approach angle, stopping distance, and the like. In the context of aircraft, operational constraints may affect fuel consumption, altitude, ground speed, and the like. Flight operations increase in complexity as the number of operational constraints increases. Part of the complexity is that each operational constraint may have a temporal relevance. Further, each operational constraint may comprise a plurality of parametric constraints, and each of those parametric constraints may influence a different aircraft subsystem, possibly at a different time. Further still, as operational environments become more complex, the amount of associated operational constraints governing operational efficiency and safety is also expanding.

Pilots receive information regarding the anticipated operational environment through various sources. One source of operational constraints, such as vehicle capabilities, is the minimum equipment list (MEL). Often, a pilot is handed a paper copy of a MEL and briefed on the operational constraints prior to starting a flight operation. After the briefing, the pilot must recall the respective parametric constraints and vehicle capabilities, consider relevant environmental data, associate the parametric constraints with a respective subsystem, and make the association at the appropriate time/location along a flight plan in order to make appropriate vehicle decisions. Any untimely recall of parametric constraints may lead to reduced anticipation time and unexpected aircraft performance. Consequently, this process represents a high cognitive workload for the pilot.

Accordingly, a vehicle decision support system capable of processing operational constraints, a flight plan, and appropriate environmental data to generate timely and readily comprehensible guidance is desirable. The desired decision support system improves the incorporation of operational constraints in a flight operation, as well as the timeliness and accuracy of their incorporation. The desired decision support system thereby improves overall aircraft safety.

BRIEF SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter.

A method for providing decision support for a vehicle is provided. The method comprising: receiving a travel plan; receiving vehicle data comprising a constraint; and processing, using stored rule sets associated with respective constraints, the travel plan and the vehicle data to determine whether an anomaly is predicted, wherein an anomaly comprises a constraint violation; when an anomaly is predicted, generating a guidance report characterizing the anomaly; and when an anomaly is not predicted, generating an indication of conformance; and repeating the step of processing when the constraint changes.

A system for providing decision support for a vehicle is also provided. The system comprising: a memory device; and a processor coupled to the memory device and configured to receive a travel plan; receive aircraft data comprising a constraint; process the aircraft data, travel plan, and third party data with stored rule sets associated with respective constraints to determine whether an anomaly is predicted, wherein an anomaly is a violation of the constraint; generate a guidance report characterizing the anomaly when an anomaly is predicted; and generate an indication of conformance when an anomaly is not predicted.

In addition, a vehicle comprising is provided, comprising: a memory device; and a processor coupled to the memory device and configured to receive a travel plan; receive vehicle data comprising a constraint; process the vehicle data, travel plan, and environmental data with stored rule sets associated with constraints to determine whether an anomaly is predicted, wherein an anomaly comprises a violation of the constraint; generate a guidance report characterizing the anomaly when an anomaly is predicted; and generate an indication of conformance when an anomaly is not predicted.

Other desirable features will become apparent from the following detailed description and the appended claims, taken in conjunction with the accompanying drawings and this background.

BRIEF DESCRIPTION OF THE DRAWINGS

A more complete understanding of the subject matter may be derived from the following detailed description taken in conjunction with the accompanying drawings, wherein, like reference numerals denote like elements, and.

DETAILED DESCRIPTION

Figure 1:
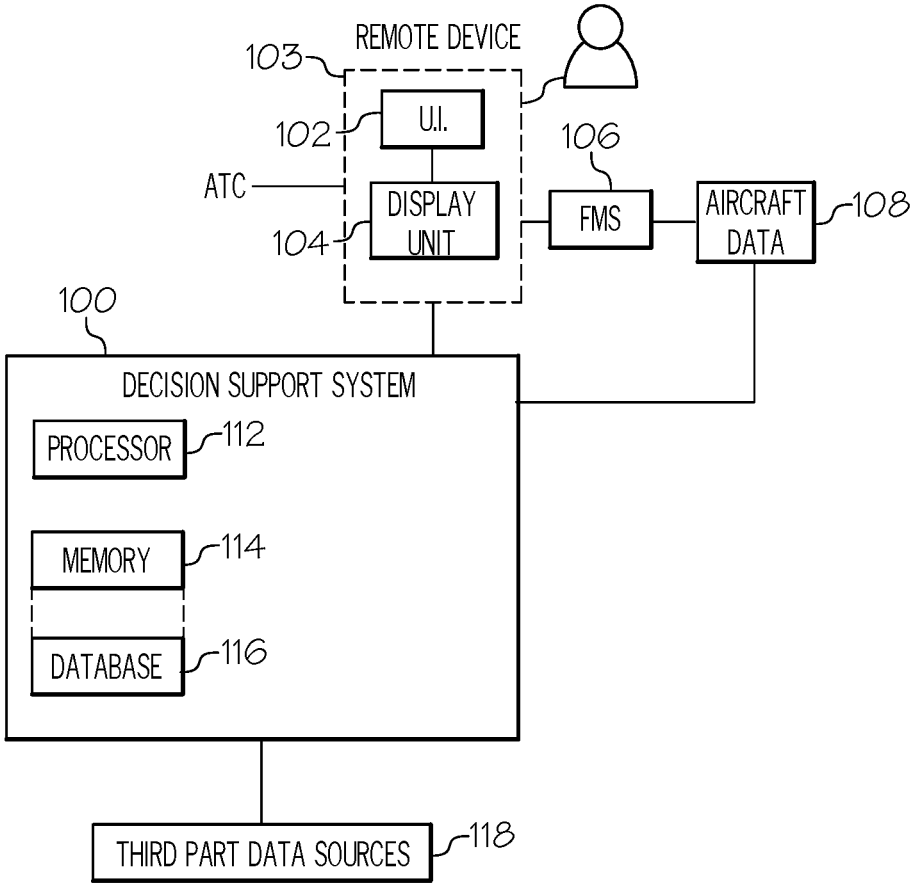
FIG. 1 is a simplified block diagram of a decision support system, in accordance with an exemplary embodiment.

The following Detailed Description is merely exemplary in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over any other implementations. Furthermore, there is no intention to be bound by any expressed or implied theory presented in the preceding Technical Field, Background, Brief Summary or the following Detailed Description.

Techniques and technologies may be described herein in terms of functional and/or logical block components and with reference to symbolic representations of operations, processing tasks, and functions that may be performed by various computing components or devices. Operations, tasks, and functions are sometimes referred to as being a set of "instructions;" such instructions may be stored in memory or a database and then computer-executed, computerized, software-implemented, or computer-implemented. The instructions may also be converted into hardware using logic gates and/or a field programmable gate array (FPGA).

In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The following descriptions may refer to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements, additional intervening elements, devices, features, or components may be present in an embodiment of the depicted subject matter.

As an overview, the below described decision support system process inputs and (i) determines whether an operational constraint violation (herein, a constraint violation is referred to as an anomaly for simplifying purposes) is predicted to occur and, if so, (ii) generates a guidance report characterizing the anomaly and associated predicted/status data. In an embodiment, the operational constraint (shortened herein to "constraint" for simplifying purposes) is received as part of input vehicle data (i.e., aircraft data), and may represent a limit or consideration regarding current or predicted vehicle status or performance. The generated predicted status/data may be used for performing decision support computations, may be used to generate recommended actions, and may be communicated to air traffic control (ATC), ground stations, and/or other aircraft. In an embodiment, a constraint may first be identified from the aircraft data by decision support system 100, and then stored into memory 114 or a database 116 for use in the decision support process. In another embodiment, aircraft data may be preloaded into memory 114 or a database 116, then retrieved and processed to identify a constraint. In yet another embodiment, a constraint may be entered by a user prior to flight (either directly into the system, or via a remote device), in order for the pilot to review results from a what-if scenario builder (a feature of the decision support process described in more detail below). The decision support system 100 is continuously evaluating input, and constraints may be modified via user input or by an external system.

FIG. 1 is a simplified block diagram of a decision support system 100, according to an embodiment. Within the decision support system 100, a processor 112 is coupled to memory 114 and database 116, and configured to receive input from a remote device 103, third party data sources 118, and a vehicle data source, such as aircraft data source 108.

Figure 2:
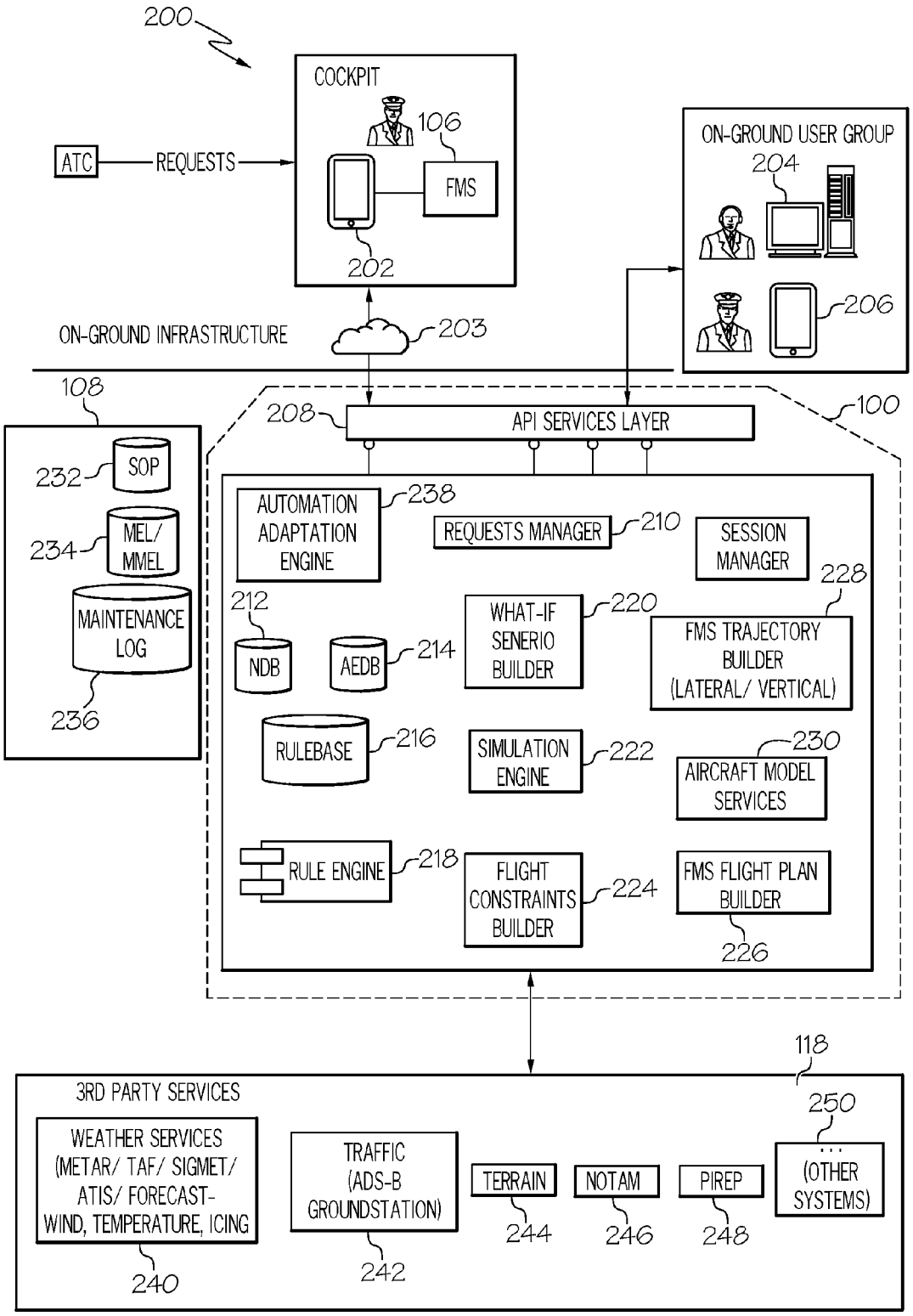
FIG. 2 is a detailed block diagram of a decision support system, in accordance with the exemplary embodiment.
Figure 5:
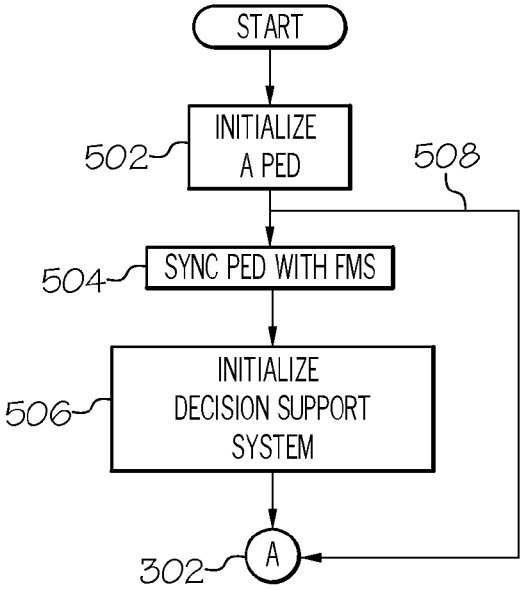
Figure 6:
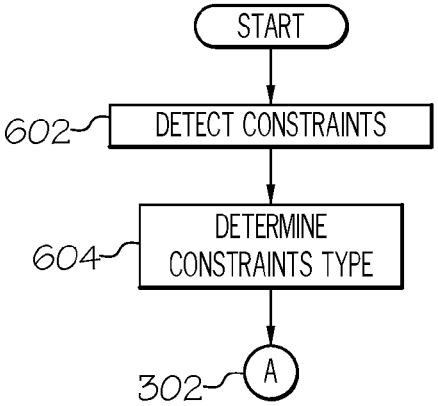

In practice, processor 112 may comprise, or be associated with, any suitable number of individual microprocessors, flight control computers, navigational equipment, memories (such as memory 114), power supplies, storage devices (such as database 116), interface cards, and other standard components known in the art. In this respect, the processor 112 may include or cooperate with any number of software models, software programs (e.g., aircraft display programs) or instructions designed to carry out the various methods, process tasks, calculations, and control/display functions described below. For example, FIG. 2 provides a detailed block diagram in which processor 112, memory 114 and database 116 are divided according to an exemplary embodiment, to support functionality of the decision support system 100. Accordingly, processor 112 may be "dis-integrated," and reside within one or any combination of: an onboard maintenance system, a mobile electronic device, and a stationary location, such as a ground station; when the processor of the decision support system 100 comprises "disintegrated" components, a synchronization process may be performed to assure that communication is synchronized (see, for example, FIG. 5, STEP 504).

Remote device 103 may be a mobile device, and may take the form of a personal electronic device (PED), as such; it may be regularly carried on and off a vehicle or may semi-permanently reside in a vehicle. Alternatively, the remote device 103 may be separate from the vehicle, such as at a ground station. In an embodiment, there is more than one remote device 103, they are spatially separated, and they independently communicate with the decision support system 100; for example, a first remote device may be in a first location and a second remote device may be in a second location (multiple remote devices are described in connection with FIG. 2). Each remote device 103 may include a user interface 102 and interact with the decision support system 100 via a subsystem referred to as an application program interface (API) (FIG. 2, API 208). An example of the input received from a remote device 103 is a "travel plan." In an embodiment, the vehicle is an aircraft and the "travel plan" is an industry standard flight plan. Depending on the embodiment, the remote device 103 may further comprise or be coupled to a flight management system (FMS) 106 inside a cockpit.

During flight, the decision support system 100 remains connected with ground servers and continuously evaluates safety, regulatory compliance, performance ramifications, anomalies, threats, and the like. Based thereon, decision support system 100 may delegate some or all of the processing activities to the remote device 103. The decision support system 100 proactively alerts pilots and air traffic control personnel to predicted events. In reliance upon the predicted events generated by decision support system 100, a user may strategically plan and avoid the predicted events and threats, effectively reducing situational workload spikes and improving overall safety and cost performance (as well as preventing pilots from violating regulatory restrictions related to flight plan and procedures).

In addition to a user interface 102, each remote device 103 may comprise a display unit 104. Image-generating devices suitable for use as the display unit 104 may take the form of a primary flight display (PFD) and a multi-function display (MFD), and include various analog (e.g., cathode ray tube) and digital (e.g., liquid crystal, active matrix, plasma, touch sensitive, etc.) display devices. In certain embodiments, display unit 104 may assume the form of a Head-Down Display (HDD) or a Head-Up Display (HUD) included within an aircraft's Electronic Flight Instrument System (EFIS).

During operation of the decision support system 100, the display unit 104 may additionally be configured with components of the vehicle to render an image comprising a map for navigating the vehicle. Displaying a guidance report may comprise overlaying any image already displayed (such as the aforementioned map) on the display unit 104 with formatted alphanumeric information, such as a text box, a table, and/or symbols. Additionally, the processor 112 may generate message data associated with the decision support system 100 and may command the display unit 104 to overlay an existing displayed image with message data.

In various embodiments, the user interface 102 may be realized as one or more of: a keypad, touchpad, keyboard, mouse, touchscreen, cursor control device, joystick, knob, microphone, gesture reader, or any other suitable device adapted to receive input from a user. In practice, the user may view an image on the display unit 104, and respond to the displayed information by providing user input by touching an area of the display unit 104 that is touch sensitive, and/or by touching or otherwise entering user input on any other suitable user interface 102.

In the exemplary embodiment, vehicle data is aircraft data, provided by aircraft data source 108, which is coupled to the decision support system 100. The aircraft data source 108 may be located in part of a ground infrastructure, may be distributed among many locations, and/or may be part of a remote device 103. In an embodiment, the aircraft data source 108 comprises a plurality of sub-sources which collectively provide "aircraft data;" aircraft data comprises standard operating conditions (SOP), minimum equipment lists (MELs), maintenance logs, current Aircraft speed, altitude, position (latitude and longitude), current fuel onboard, model of the aircraft (e.g. Boeing 747/Airbus A320 etc.), and a tail number of the aircraft, which allows for retrieval of exact details of avionics and databases onboard a given aircraft; each of which may comprise constraints that the decision support system 100 evaluates in its determination of whether an anomaly is predicted.

Non-limiting examples of anomalies include exceeding a maximum altitude, or a minimum altitude, exceeding a maximum airspeed, deviating from a flight path by more than a predetermined amount. In some embodiments, sensors located in various vehicle subsystems are also a vehicle or aircraft data source. In an embodiment, a user may modify aircraft data and the modified aircraft data is at that time sourced from a user interface 102.

Third party data (also referred to herein as environmental data) may collectively include weather data and weather forecasts, traffic data, terrain data, notices to airman (NOTAM), and pilot reports (PIREPs), and third party data supports the temporal relevance of the decision support system and may be (i) current or (ii) the predicted value at a location where aircraft is going to be at a given time. Third party data sources 118 comprise one or more data sources each individually located. Third party data sources 118 may include Weather Services, such as METAR (Meteorological Terminal Air Report), TAF (Terminal Aerodrome Forecast), SIGMET (Significant Meteorological Information), ATIS (Automatic Terminal Information Service), ADS-B (Automatic Dependent Surveillance-Broadcast), a ground station, a terrain database, and various sensors.

As mentioned above, the processor 112 is configured to process aircraft data, a travel plan, and third party data to determine whether (and where) an anomaly is predicted within or along the flight plan. As used herein, an anomaly represents one or more constraint violations predicted to occur anywhere within the travel plan. In addition, one constraint may lead to more than one predicted anomaly.

When the processor 112 predicts an anomaly, the processor 112 generates a guidance report. Accordingly, if the processor 112 predicts a plurality of anomalies, the processor 112 generates a respective guidance report for each anomaly of the plurality of anomalies. When the processor does not predict any anomalies, the processor 112 generates an indication of conformance. The processor 112 continually processes inputs and generates guidance reports and/or indications of conformity.

When the processor 112 generates either the guidance report or the indication of conformance, the processor 112 may do so using any combination of alert and/or notification methods. For example, the processor 112 may command a display unit 104 to display the guidance report and/or the indication of conformance on the display unit 104. In an embodiment, the guidance report is overlaid on an existing image already displayed on the display unit 104. As previously mentioned, the guidance report and/or indication of conformance may take the form of an alphanumeric list, a table, or one or more symbols.

The guidance report characterizes the anomaly. As used herein, the guidance report "characterizing the anomaly" means that it includes specifics about the anomaly, and associates recommendations with the anomaly. Examples of specifics about the anomaly include: constraint type, level of alert, type of alert, affected subsystem(s), and a predicted spatial location of relevance. Examples of recommendations include strategic alternate solutions and tactical instructions. The guidance report may associate an anomaly with a respective strategic alternate solution or with a respective tactical instruction. For some anomalies, the anomaly is associated with both a strategic alternate solution and a tactical instruction. Accordingly, the decision support system 100 and method provides decision support by timely alerting a pilot to predicted anomalies and providing the pilot (on the display unit 104) with respective recommendations for adaptations (strategic alternate solutions and/or tactical instructions). In doing so, the decision support system 100 and method relieves pilot cognitive workload and increases safety.

Figure 8:
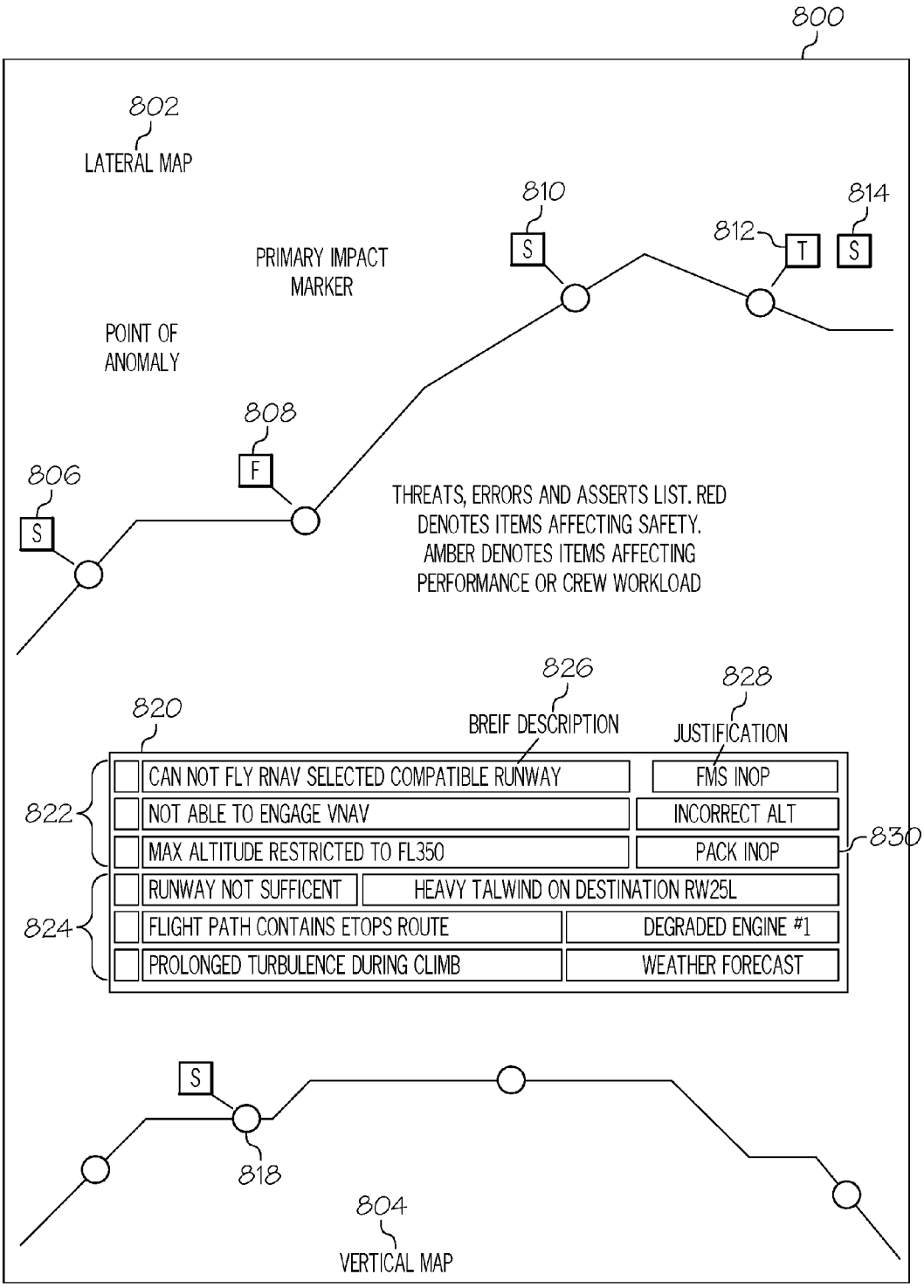
FIGS. 8-10 are examples of guidance reports on a display unit, in accordance with an exemplary embodiment.

In an embodiment, the decision support system 100 further reduces the pilot's cognitive workload by presenting information in a readily comprehensible, intuitive manner so that it is easier to process. For example, the processor 112 may categorize the anomaly by type, such as, concerning a threat, safety, or fuel; and, may overlay a symbol representative of the categorized anomaly on at least one of: a lateral map and a vertical map (FIG. 8 depicts symbols representative of anomaly type). Techniques for rendering symbols in a visually distinguishable form may also be employed. Such techniques may include the use of color coding, flashing, highlighting, and the like. For example, the decision support system 100 may render a categorized anomaly in a first symbol with a first visually distinguishable form (i.e., red) if the anomaly affects safety, and a second symbol in a second visually distinguishable form (i.e., amber) if the anomaly does not affect safety.

In response to viewing the generated guidance report, a user may decide to modify, via the user interface 102, one or more inputs to the decision support system 100. In an embodiment, the decision support system 100 is configured to receive a modification to at least one of (i) the travel plan and (ii) the aircraft data. In response to receiving a modification to at least one of (i) the travel plan and (ii) the aircraft data, the decision support system 100 repeats the steps of processing and generating. The image on the display unit 104 may then be updated based on modified input, giving the pilot another opportunity to review any guidance reports generated therefrom.

As alluded to above, the processor 112, memory 114, and database 116 may be cooperatively configured or sub-divided to take the form of a plurality of subsystems, each of which are configured to perform a specific function of the decision support system 100. FIG. 2 presents an example showing the processor 112, memory 114, and database 116 cooperatively configured or sub-divided. One with skill in the art will readily appreciate that the functionality of the decision support system 100 may be achieved using a variety of configurations in addition to that shown in FIG. 2 while still adhering to the scope of the invention.

FIG. 2 is a detailed block diagram of the decision support system 100 of FIG. 1, in accordance with an exemplary embodiment. As an integrated system, decision support system 100 provides the ability to divert, while in flight, and when the systems on board are malfunctioning, performance of certain computations (this is often referred to as "avionics virtualization"). Some examples include:

- MEL failed fuel indicator could result in the fuel computations being performed off-board by FMS components on ground.
- Valid Latitude/Longitude positions being provided by valid Navigation database on ground when flying with a MEL failed flight management controller (FMC) due to having an expired navigation database (NavDB).
- Modified flight plan creation performed on ground when flying ETOPS with a malfunctioning PACK (Overweight landing computations etc.).
- Upon experiencing a MEL failed Thrust Reverser; determine the best runway to use at the destination based on the predicted wind, runway length and direction. In case all the runways are inadequate, determine closest alternate airports where the aircraft can make a safe landing.

A first remote device 103 from FIG. 1 may take the form of a portable electronic device (PED) that is carried onto an aircraft, as depicted by remote device 202. A second remote device 103, utilized at a ground station, may take the form of a PED, depicted as remote device 206 or as a server or computer utilized at a ground station, such as remote device 204. Depending upon the application, communication between a remote device 103 and a vehicle, such as an aircraft, may be coupled through a cloud 203.

As mentioned above, the processor 112, memory 114 and database 116 may be cooperatively configured to form a plurality of subsystems, each providing a respective service or function in the overall function of the decision support system 100. What follows is a description of one such exemplary embodiment of subsystems and their functions.

API Services Layer (API 208) is a set standard interfaces that each allow input/output to and from decision support system 100. API Services Layer 208 couples the decision support system 100 to applications running on remote devices (202, 204, 206), such as tablets, PEDs or desktops running a web-interface, as well as to the FMS 106. API Services Layer 208 will take input/output in any prevailing formats of input/output standards for web-services connectivity between service provider and user. In an embodiment, the API Services Layer 208 will take input/output in representational state transfer (REST) or extensible markup language (XML) format.

Request Manager 210 is responsible for handling multiple client (i.e., multiple remote devices 103) requests, through the API 208, and configured to determine when to service or process a particular client request (e.g. selecting the appropriate database 116, such as an Aero Engine Database (AEDB), or Navigation database (NDB), etc.).

Database 116 may comprise multiple databases, such as Navigation Databases (NDB) 212, to store information required by the client (remote device 103) to be used by decision support system 100; and, Aero Engine Database (AEDB) 214 (such as, an Aircraft Performance Database), to provide access routines for accessing Data Tables used to model the Airframe and Engine parameters. Such Data Tables may include information for: center of gravity (CG), Drag, Fuel Flow, Speeds, Thrust, and the like. The decision support system 100 determines the suitable AEDB 214 to reference in performance computations (e.g. calculation of Speeds, Optimum altitude, etc.) in the process of predicting an anomaly.

Rulebase 216 may contain rule sets that link a recommended action to be taken on encountering specific constraints. These rules are condition/action pairs that are used to determine the optimum solution based on the client (remote device 103) request. User defined constraints can be provided as input in the form of rule sets to enable pilots/operators to fine-tune their anomaly scenarios for which decision support system 100 will detect and provide strategic/tactical guidance.

Rule Engine 218 processes rules depending on updated inputs to the decision support system 100, such as, aircraft state parameters, and third party systems like Terrain/Weather/NOTAMs/MELs. It dynamically selects the required rules for evaluation by determining a condition and executes the "actions" of the selected rules. Rules can be chained together a priori, or be provided individually, to address specific scenarios.

What-If Scenario builder 220 comprises a specific list of canned scenario types that can be instantiated. These scenarios cater to frequently used cases, such as: determine closest suitable airport; determine the range and time to reserve fuel state for the particular aircraft; determine a path around a weather disturbance using smart offsets, etc. What-If Scenario builder 220 also enables a pilot or dispatcher to test and feel the effect of a hypothetical constraint, system limitation, or non-normal scenario. Accordingly, the pilot may perform this test on remote device 103 before even getting into the cockpit (see, for example, the pathway supported by FIG. 4).

A simulation engine 222 performs simulations of the flight based on the input aircraft data, aircraft configuration, flight plan, and third party data.

Flight Constraints Builder 224 is responsible for taking the input aircraft data as constraint files (Pilot/Airline specified), converting them into FMS speed/altitude/thrust constraints, and modifying the flight plan with these constraints, to determine whether an anomaly has occurred.

FMS Flight Plan Builder 226 receives the input flight plan and inserts the input flight plan into decision support system 100. This component may comprise a portion of the FMS, or will provide all the flight planning features that are available in a conventional FMS.

FMS Trajectory Builder 228 builds and inserts the lateral and vertical trajectory of the input flight plan into decision support system 100. This component is created out of FMS trajectory components and will provide all the lateral and vertical trajectory generation features that are available in conventional certified FMS software.

Aircraft Model Services 230 module processes aircraft specific AEDB and algorithms to generate optimum altitude, speed computations for specified modes, envelopes, and the like.

Vehicle databases, such as aircraft data source 108 may be a source of specific sets of airline maintained databases and Standard Operating Procedures 232 (SOP). The databases may comprise maintenance logs 236, MEL/MMEL 234 (Minimum Equipment List/Master Minimum Equipment Lists), AMI (Airline modifiable information), OPC (Operational Program Configuration), and the like. Data from these databases are made accessible to decision support system 100.

Automation Adaptation Engine 238 provides the automation parameter adaptations, checklists, pilot task adaptation, time driven operational guidance to the pilot to cope with the predicted anomaly, and attendant system limitation/constraints. In addition, Automation Adaptation Engine 238 generates recommendations and solutions to predicted anomalies, both strategically and tactically. For example, a recommendation or solution may include the dimensions of fuel/range/time/altitude/speed, etc.

As previously mentioned, the third party services are a plurality of sources in the hyperconnected vehicle environment from which the decision support system 100 receives the latest environmental data. Third party services comprise Weather information 240 (Current/Forecast), Terrain databases 244, Traffic information 242, NOTAMs 246, PIREPs 248, and other similar systems 250. These are available to decision support system 100 through one or more APIs 208. By keeping more refined and high volume data services, such as the third party services, out of onboard avionics, faster processing and access times may be achieved in the onboard avionics, such as in remote device 202.

Communication from the ground based systems to one or more remote devices 202, 204, and 206, could be in the form of $K_a$ Band (where the $K_a$ band refers to a band directly above the K-band. This 30/20 GHz band is used in communication satellites and high-resolution, close-range targeting radars aboard military airplanes), Aeronautical Mobile Airport Communications System (AEROMACS), ADS-B, satellite communication (SATCOM), Global System for Mobile Communications (GSM Networks), and the like.

Thus, FIG. 2 provides an exemplary embodiment depicting one of many possible cooperative configurations of the processor 112, memory 114 and database 116 to form a plurality of subsystems, each subsystem providing a respective service or function in the overall function of the decision support system 100.

FIGS. 3-7 are flow diagrams illustrating steps of a process for a decision support system, in accordance with an exemplary embodiment. It is to be understood that the steps may be combined or arranged in a variety of different manners while still adhering to the inventive concept. Invoking (FIG. 3 STEP 304) the decision support process 300 is similar to compiling a program, in that, the entire flight plan is processed with the aircraft data comprising constraints and environmental data to determine or predict any anomalies. Recall that the processor may be distributed among locations; accordingly, the decision support process 300 may be invoked by a ground station, a remote device, or within a cockpit. When performed by a ground station, continuous monitoring of a flight to proactively look for standard operating procedure and/or regulatory compliance violations may be performed.

Figure 3:
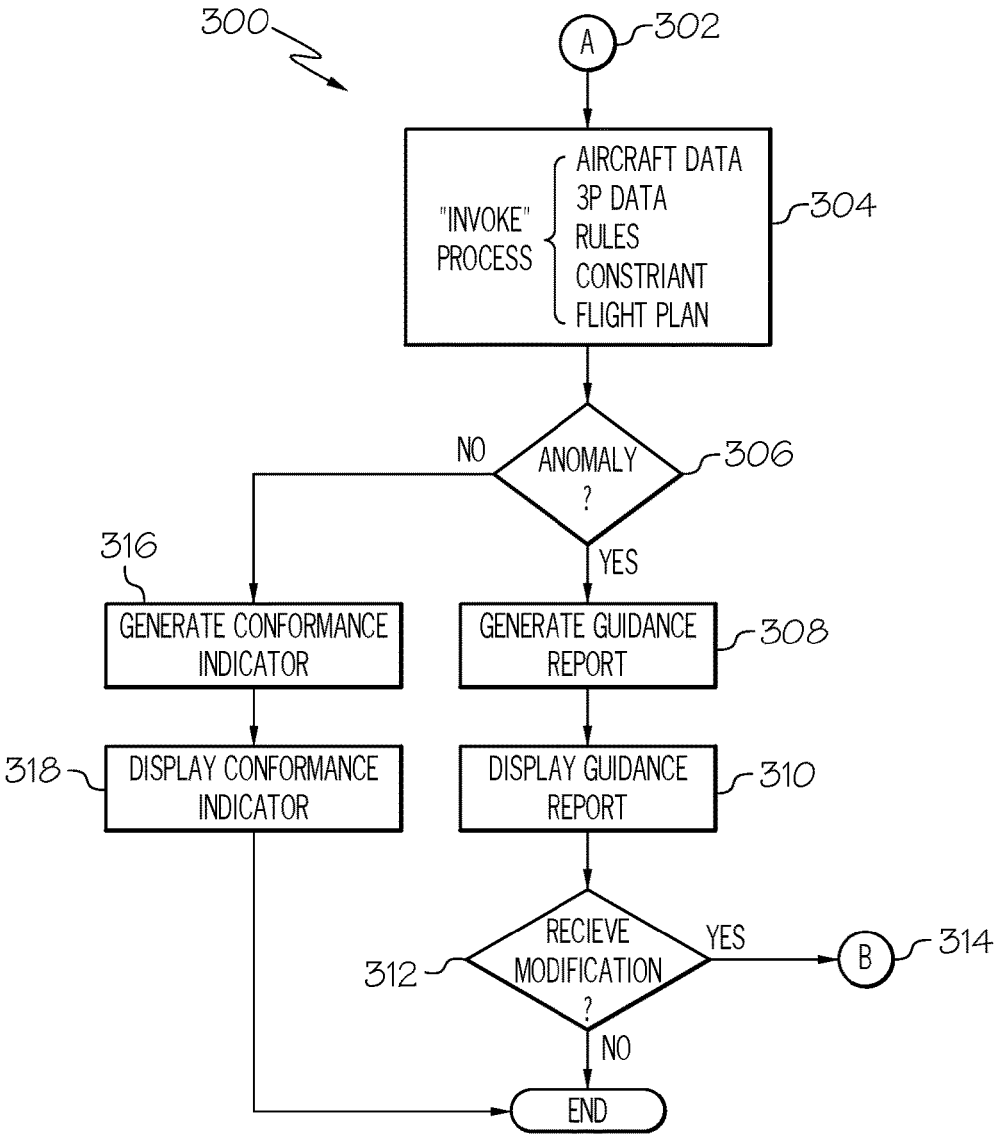
FIGS. 3-7 are flow diagrams illustrating a process for a decision support system, in accordance with an exemplary embodiment.

FIG. 3 illustrates the steps of the decision support system 100 from the point of invoking (STEP 304) the decision support process 300 onward, and FIGS. 4-7 illustrate different paths (STEP 302) that may occur prior to invoking the decision support process 300. Upon entering a cockpit, the pilot may upload aircraft data and/or synchronize a remote device with the decision support system 100; synchronizing a remote device with the decision support system 100 triggers the decision support process 300 to initialize (STEP 506) and invoke (STEP 304) again, thus performing another round of processing and generation. In some embodiments, synchronizing a remote device with the decision support system 100 may result in adaptations to parameters in existing aircraft procedures, such as "SmartChecklist/"SmartProcedure," as well as the generation of additional pilot alerts, reminders, and additional cross checks.

A variety of inputs to decision support process 300 are received or obtained through an API Services Layer 208. When invoked, the processor 112 processes inputs that may comprise any combination of: a flight plan, vehicle or aircraft data, third party data, and rules, to determine whether an anomaly is predicted (STEP 306) (as previously described, an anomaly is used herein to mean a violation of one or more constraints at any point along the flight plan). When an anomaly is predicted, a guidance report is generated (STEP 308) and, the guidance report may be displayed at STEP 310. The user or pilot may input a modification (STEP 312, STEP 314) to one or more inputs to the decision support process 300 after reviewing the generated guidance report. When the process does not receive a modification at STEP 312, it ends. When the decision support process 300 does not detect an anomaly at STEP 306, it may generate an indication of conformance (STEP 316) and may display an indication of conformance (STEP 318).

Figure 4:
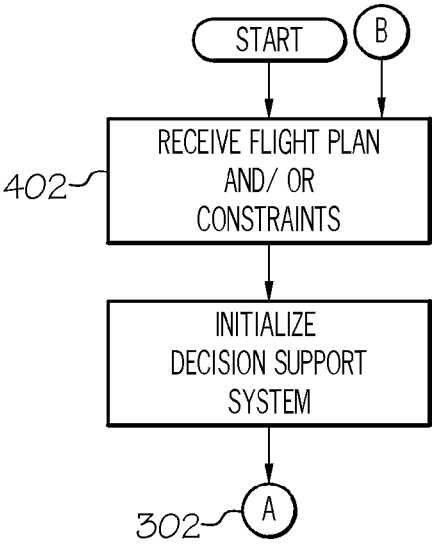

As previously mentioned, decision support process 300 may be invoked (STEP 304) after several other steps have occurred. FIG. 4 illustrates a manner in which the decision support process 300 may be invoked a first time. In FIG. 4, a pilot or user inputs into the decision support system 100 the flight plan and at least one constraint (STEP 402). After the flight plan and constraint is received, the decision support system 100 is initialized in STEP 404, and then the process moves to STEP 302 and STEP 304, invoking the decision support process 300 as described above.

In an alternative path (FIG. 5) a remote device 103, such as a personal electronic device (PED) is initialized at STEP 502 and synchronized with the Flight Management Service (FMS) at STEP 504. Next, the PED is synchronized with the decision support system 100 at STEP 506. The decision support process 300 is then invoked at STEP 304. In another variation, the pilot can run the decision support system 100 from the remote device 103, itself, even before going to the cockpit (path 508); in such a scenario, the pilot may later perform steps 504 and 506.

Figure 7:
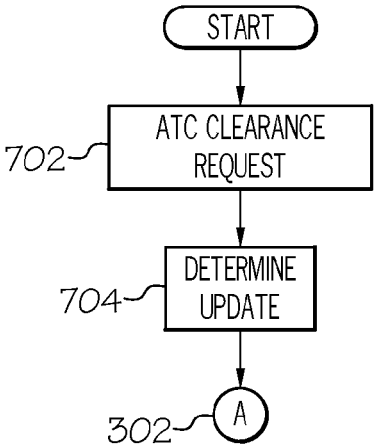

In yet another path (FIG. 6), the decision support process 300, already invoked and running, detects a new constraint at STEP 602, and determines a constraint type (wherein the constraint type references how the constraint effects any piece of vehicle equipment or performance, such as the air-conditioning PACK), at STEP 604 before re-invoking the decision support process 300 at STEP 304. FIG. 7 illustrates a scenario in which the process is already running, and the air traffic control (ATC) provides a command, such as a clearance request (STEP 702), which triggers an update to the flight plan. In response to this updated input, the decision support process 300 determines what other updates [to inputs such as third party services] are required at STEP 704, before re-invoking the decision support process 300 at STEP 304.

FIGS. 8-11 are examples of guidance reports on a display unit, in accordance with an exemplary embodiment. As mentioned, the display of a guidance report may take on many forms. In FIG. 8, a display 800 comprises a lateral map 802 and a vertical map 804. Symbols representative of anomalies (806, 808, 810, and 812) are overlaid on the lateral map 802 at their respective location of predicted occurrence. Likewise, a symbol representative of an anomaly (818) is overlaid on the vertical map 804 at its respective location of predicted occurrence. In FIG. 8, the symbols are squares with a visually distinguishable background having letters enclosed. For example, S may stand for a safety concern, F for a fuel concern, and T for a threat. Shading, color, or other techniques may be employed to depict levels of concern, as described above (for example, 806 and 814 are depicted in a first visually distinguishable form and 808, 810 and 812 are depicted in a second visually distinguishable form).

The guidance report may be overlaid on the existing image, for example, as a table 820. In table 820, alphanumeric information providing a brief description 826 and a justification 828 may be provided. The alphanumeric information of the brief description 826 may include recommendations (strategic alternate solutions and/or tactical instructions). Within the table 820, color coding or visually distinguishable techniques may also be employed (for example, entries 822 and entries 824).

Figure 9:
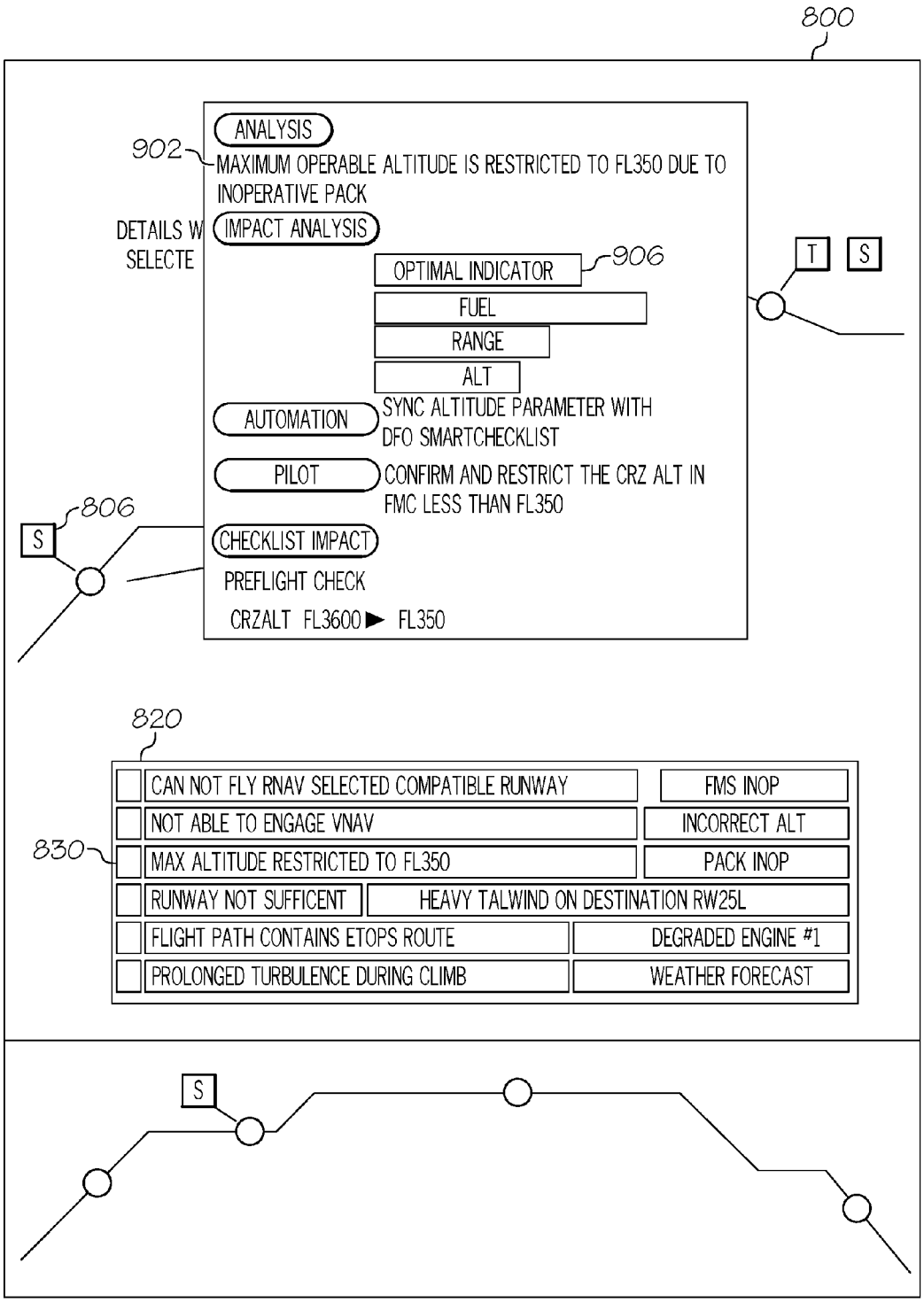

The user may select an anomaly, via user interface 102, to obtain more information about the anomaly. For example, in response to a user selection of entry 830, the MAX altitude restricted to FL350 entry, the decision support system 100 may display additional information. As shown in FIG. 9, pop-up window 902 provides additional alphanumeric and symbolic information associated with entry 830. In this example, the detail in pop-up window 902 provides additional information associated with entry 830, which indicates that the maximum operable altitude is restricted to flight level 350 (or 35,000 feet) due to an inoperative icing PACK, and further, displays a bar called an "optimal indicator" 906 for a visual representation of the status of the aircraft based on the anomaly. Under the heading "impact analysis," bars extend from left to right and may be compared to the optimal indicator 906. For example, In FIG. 9, the fuel bar is seen to extend to the right of the optimal indicator 906, which indicates that the fuel burn will be higher than optimal; the range bar does not extend to the left as far as the optimal bar, and neither does the altitude bar, indicating that range and altitude are reduced compared to their planned values.

Figure 10:
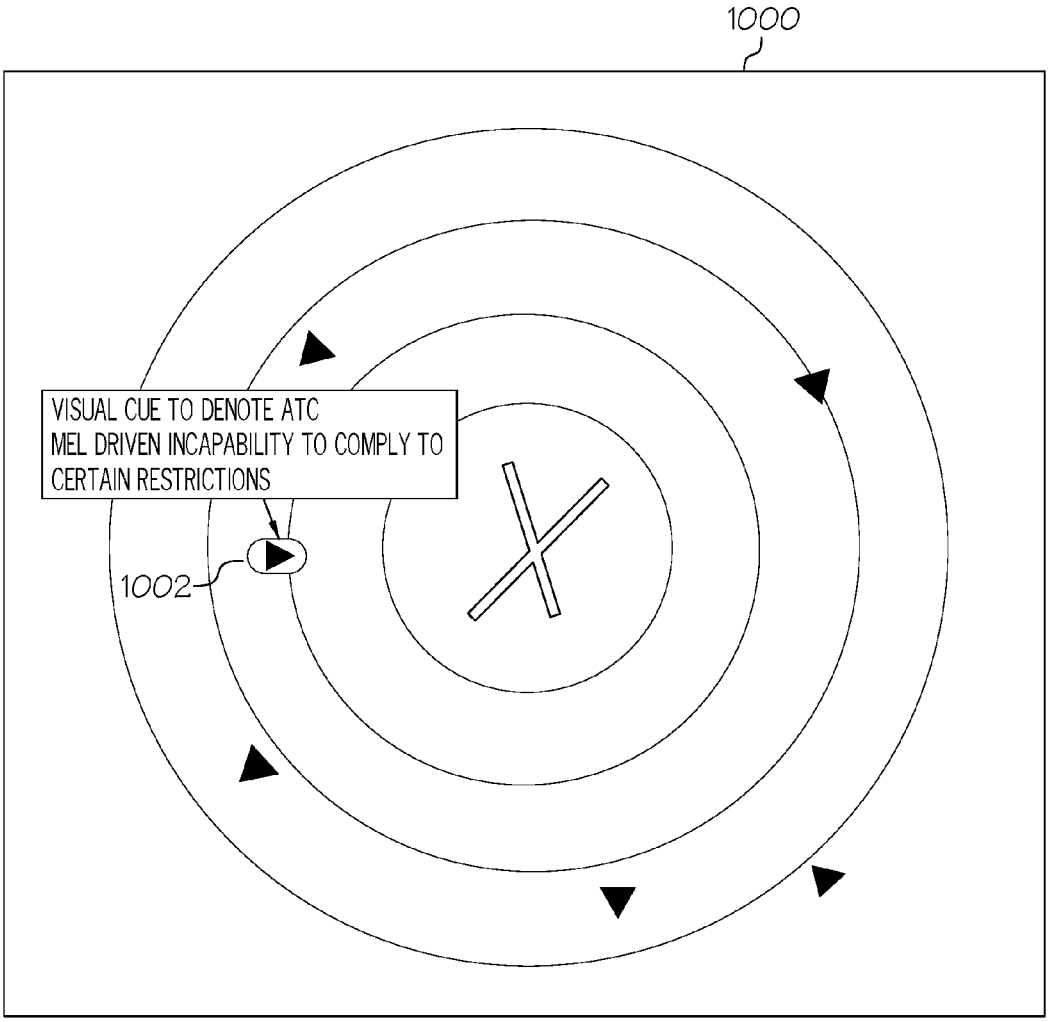

FIG. 10 provides another exemplary display view to assist a pilot or crew in an aircraft or person such as an air traffic controller (ATC) in a ground station. On display 1000, triangles are the symbols used to denote neighboring aircraft, and the triangle symbol representing the host aircraft is enclosed by a shape 1002 rendered in a visually distinguishable technique in order to alert the pilot that the ATC should be alerted to an inability to comply with a request from ATC due to a constraint provided by, for example, a MEL.

Thus, there has been provided a vehicle decision support system and method capable of processing operational constraints, a flight plan, and appropriate environmental data to generate timely and readily comprehensible guidance. The provided decision support system and method improves the incorporation of operational constraints, and the timeliness and accuracy of their incorporation. The desired decision support system thereby improves overall aircraft safety.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for providing decision support for an aircraft, the method comprising:

receiving a flight plan;

receiving vehicle data from a standard operating procedures (SOP) database, a maintenance log database, and a minimum equipment list database, the vehicle data comprising, for the aircraft, a constraint, the constraint defined as a limit on at least one of (i) current performance, and (ii) predicted performance;

receiving, from a third party data source, third party data comprising environmental data; and processing the flight plan, the vehicle data, and the third party data to determine, (a) whether there is a constraint violation, defined as an anomaly, along the flight plan, and (b) when it is determined that there is an anomaly along the flight plan, (i) determining where the anomaly is along the flight plan; and (ii) generating a guidance report characterizing the anomaly by constraint type, an affected subsystem, and a predicted spatial location of relevance; and when an anomaly is not predicted, generating an indication of conformance; and repeating the step of processing when the constraint changes.

2. The method of claim 1, wherein the vehicle data further comprises at least one of: current fuel on-board, model of the aircraft, and tail number of the aircraft.

3. The method of claim 2, further comprising, when an anomaly is predicted, delegating at least some processing to a remote device.

4. The method of claim 3, further comprising displaying the guidance report on a display unit in the aircraft when an anomaly is predicted.

5. The method of claim 4, wherein the guidance report associates the anomaly with a respective strategic alternate solution.

6. The method of claim 4, wherein the guidance report associates the anomaly with a respective tactical instruction.

7. The method of claim 4, further comprising receiving a modification to at least one of (i) the flight plan and (ii) the vehicle data.

8. The method of claim 7, further comprising repeating the steps of processing and generating in response to receiving the modification.

9. The method of claim 4, wherein the guidance report associates the anomaly with at least one of (i) a respective strategic alternate solution and (ii) a respective tactical instruction; and further comprising categorizing the anomaly selectively from among: a threat, a safety concern, and a fuel concern.

10. The method of claim 9, further comprising overlaying a symbol representative of the categorized anomaly on at least one of a lateral map and a vertical map.

11. The method of claim 10, further comprising rendering the symbol representative of the categorized anomaly in a first visually distinguishable form if the anomaly affects safety, and rendering the symbol representative of the categorized anomaly in a second visually distinguishable form if the anomaly does not affect safety.

12. The method of claim 9, further comprising:

receiving a user selection of the anomaly; and in response to receiving the user selection of the anomaly, displaying additional information associated with (i) the anomaly and (ii) the respective strategic alternate solution.

13. The method of claim 9, further comprising:

receiving a user selection of the anomaly; and in response to receiving the user selection of the anomaly, generating additional information associated with (i) the anomaly and (ii) the respective tactical instruction.

14. A system for providing decision support for a vehicle, the system comprising:

a memory device; and a processor coupled to the memory device and configured to receive, from a remote device, a travel plan;

receive vehicle data from one of: a standard operating procedures (SOP) database, a maintenance log database, and a minimum equipment list database, the vehicle data comprising a constraint, the constraint defined as a limit on at least one of (i) current performance, and (ii) predicted performance;

receive, from a third party data source, third party data comprising environmental data;

process the travel plan, the third party data, and the vehicle data, to determine, (a) whether there is a constraint violation, defined as an anomaly, along the flight travel plan, and (b) when it is determined that there is an anomaly along the flight travel plan, (i) determine where the anomaly is along the flight travel plan; and (ii) generate a guidance report when an anomaly is predicted, the guidance report characterizing the anomaly by constraint type, an affected subsystem, and a predicted spatial location of relevance; and generate an indication of conformance when an anomaly is not predicted.

15. The system of claim 14, wherein:

the processor is further configured to delegate at least some of the processing to the remote device when an anomaly is predicted.

16. The system of claim 15, wherein, if an anomaly is predicted, the processor is further configured to display on a display unit in the vehicle, (a) the guidance report comprising alphanumeric information associating the anomaly with at least one of (i) a respective strategic alternate solution and (ii) a respective tactical instruction, and (b) transmit the guidance report to the remote device.

17. The system of claim 16, wherein the processor is further configured to receive a modification to at least one of (i) the travel plan and (ii) the vehicle data.

18. The system of claim 17, wherein the processor is further configured to repeat the steps of processing and generating in response to receiving the modification.

19. A vehicle comprising:

a memory device; and a processor coupled to the memory device and configured to receive a travel plan comprising a route;

receive vehicle data comprising at least one of: standard operating procedures (SOP), a minimum equipment list (MEL), a maintenance log, current fuel level the vehicle data comprising a constraint, the constraint defined as a limit on at least one of (i) current performance, and (ii) predicted performance;

receive environmental data;

process the vehicle data, travel plan, and environmental data with stored rule sets associated with constraints to determine (a) whether there is a constraint violation, defined as an anomaly, along the flight travel plan, and (b) when it is determined that there is an anomaly along the flight travel plan, (i) determine where the anomaly is along the flight travel plan; and (ii) generate a guidance report characterizing the anomaly when an anomaly is predicted; and generate an indication of conformance when an anomaly is not predicted.

20. The vehicle of claim 19, further comprising a remote device, and wherein:

the processor is further configured to synchronize vehicle systems with the remote device prior to processing the vehicle data, travel plan, and environmental data with stored rule sets associated with constraints to determine whether an anomaly is predicted; and transmit, to the remote device, one of the indication of conformance and the guidance report.

* * * * *